United States Patent [19]

Arishima et al.

[11] 4,426,434

[45] Jan. 17, 1984

[54] ELECTROPHOTOGRAPHIC PHOTORECEPTOR AND PREPARATION THEREOF

[75] Inventors: Koichi Arishima; Takeshi Okada; Akiyuki Tate, all of Mito; Hiroaki Hiratsuka, Tomobe, all of Japan

[73] Assignee: Nippon Telegraph & Telephone Public Corp., Musashino, Japan

[21] Appl. No.: 388,192

[22] Filed: Jun. 14, 1982

[30] Foreign Application Priority Data

Jun. 23, 1981 [JP] Japan ..... 56-96040
Mar. 15, 1982 [JP] Japan ..... 57-39484

[51] Int. Cl.[3] ..... G03G 5/06

[52] U.S. Cl. ..... 430/128; 430/133; 430/945; 430/58; 430/135; 252/501

[58] Field of Search ..... 430/128, 135, 133; 252/501

[56] References Cited

U.S. PATENT DOCUMENTS 3,238,149 3/1966 Spurr et al. ..... 430/135
4,214,907 7/1980 Nakazawa et al. ..... 430/82 X

*Primary Examiner*—John D. Welsh
*Attorney, Agent, or Firm*—Darby & Darby

[57] ABSTRACT

An electrophotographic photoreceptor comprises an electrically conductive substrate, a layer of charge generating material which chloroaluminium phthalocyanine and chloroaluminium monochlorophthalocyanine are evaporated in a vacuum over the electrically conductive substrate and the evaporated film of chloroaluminium phthalocyanine and chloroaluminium monochlorophthalocyanine are treated by an organic solvent selected from the group consisting tetrohydrofurane, methanol, acetone, methyl ethyl ketone, α-chloronaphthalene, pyridine, a layer of charge transport material overcoated the layer of charge generating material. The electrophotographic photoreceptor and the preparation thereof is disclosed to apply for use in a laser printing machine in which a light of laser diode or light emission diode is used as a light source. The solvent treated layer of evaporated film of chloroaluminium phthalocyanine and chloroaluminium monochlorophthalocyanine are observed to have a high photosensitivity in near infrared region, especially over 750 nM of wavelength regions.

7 Claims, 6 Drawing Figures

ELECTROPHOTOGRAPHIC PHOTORECEPTOR AND PREPARATION THEREOF

BACKGROUND OF THE INVENTION

This invention relates to an electrophotographic photoreceptor and preparation thereof, and more especially a charge generating layer of a photoreceptor comprising an evaporated film of chloroaluminium phthalocyanine and chloroaluminium monochlorophthalocyanine and providing for a treatment of an organic solvent and having a high sensitivity of near infrared region especially over 750 nM of wavelength. In the prior art of an electrophotographic photoreceptor, it is common to form a mono layer as a photosensitive layer on electrical conductive plate, for example, amorphous selenium, lead oxide, cadmium sulfide in inorganic compounds, and poly vinyl carbazole—trinitrofluorenone, pyrylium salt—triphenylmethane in organic compounds. On the other hand it has been already known that an electrophotographic photoreceptor comprising an electrode, a charge generating layer and a charge transport layer is invented. About a wavelength region of photosensitivity, former photoreceptors exclusive of the photoreceptor of metal phthalocyanines have photosensitivity in from the ultraviolet region to the visible region and reduces photosensitivity in region of near infrared, especially over 700 nM of wavelength. Accordingly, it has been investigated that various methods of sensitization are tried to obtain the photoreceptor having an excellent photosensitivity in near infrared region. For example, cadmium sulfide and lead dioxide are sensitized to add coloring agents and selenium are sensitized to add tellurium. In these cases, however, the photosensitivity of the photoreceptor reduce remarkably in region of near infrared, especially over 750 nM of wavelength. It is doubtful that the use of coloring agents as the sensitizer is unsatisfactory because of their chemical durability and also because of the physical, electrical durability of the photoreceptor in the sensitization by tellurium. On the other hand, the use of metal phthalocyanines in electrophotographic photoreceptor is well known. For example, U.S. Pat. No. 4,181,772 which discloses an adhesive generator overcoated photoreceptor therein as generating pigment metal phthalocyanine and metal-free phthalocyanine, U.S. Pat. No. 4,214,907 which discloses photosensitive material for electrophotography having a polyvinylcarbazole derivative, phthalocyanine and an electron-acceptor, British Pat. No. 1268422, which discloses phthalocyanine composition and method of preparation and UK Patent application GB No. 2023298A which discloses electrophotographic material and method therein, charge generating materials dispersed in polymer are X metal-free phthalocyanine, metal phthalocyanine, vanadyl phthalocyanine are dispersed in a polymer. However, the prior art does not indicate that the photoreceptor using metal-free phthalocyanine or metal phthalocyanine has a high photosensitivity in the near infrared region. Also it is well known that the peak of photosensitivity lies in range of wavelength from about 700 to about 800 nM in metal-free phthalocyanine, metal phthalocyanine and is gradually reduced in wavelengths longer than 750 nM. In the present invention relating to an electrophotographic photoreceptor comprising an electrically conductive substrate, a layer of charge generating material and a layer of charge transport material, it has been found that the absorption peak of chloroaluminium phthalocyanine and chloroaluminium monochlorophthalocyanine evaporated film shift from short wavelength to long wavelength with treatment by an organic solvent. The present invention provides an electrophotographic photoreceptor which has a high photosensitivity in regions of near infrared, especially over 750 nM. The region of near infrared are a stable emission region of semiconductor laser diode as well known.

SUMMARY OF THE INVENTION

It is therefor an object of this invention to provide an electrographic photoreceptor having a high photosensitivity and a large coefficient of absorption in the near infrared region.

It is another object of this invention to provide an improved photoreceptor containing a layer of charge generating material of which an evaporated film of chloroaluminium phthalocyanine and chloroaluminium monochlorophthalocyanine treated by an organic solvent have a high photosensitivity in the near infrared region. According to the present invention, an electrophotographic photoreceptor comprising an electrically conductive substrate, a layer of charge generating material evaporated over the electrically conductive substrate in a vacuum chloroaluminium phthalocyanine or chloroaluminium monochlorophthalocyanine and the evaporated film of chloroaluminium phthalocyanine or chloroaluminium monochlorophthalocyanine treated by an organic solvent, and a layer of charge transport material overcoated the layer charge generating material in double layer.

For a better understanding of the present invention and further features thereof, reference is made to the following detailed description of various preferred embodiments wherein.

Figure 3:
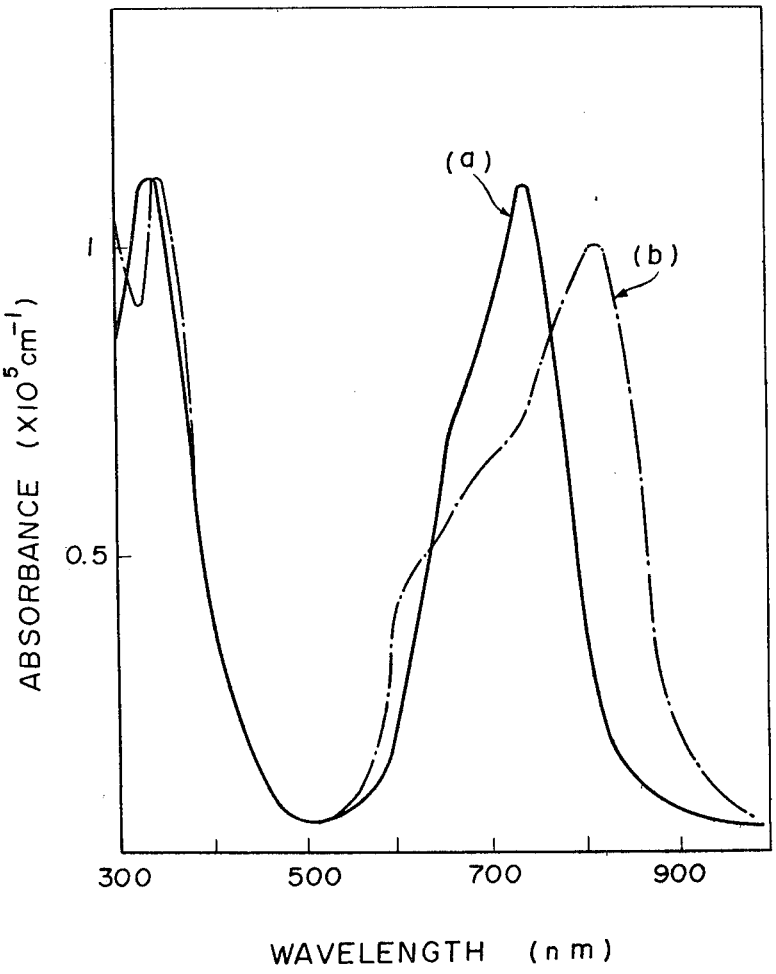
Figure 4:
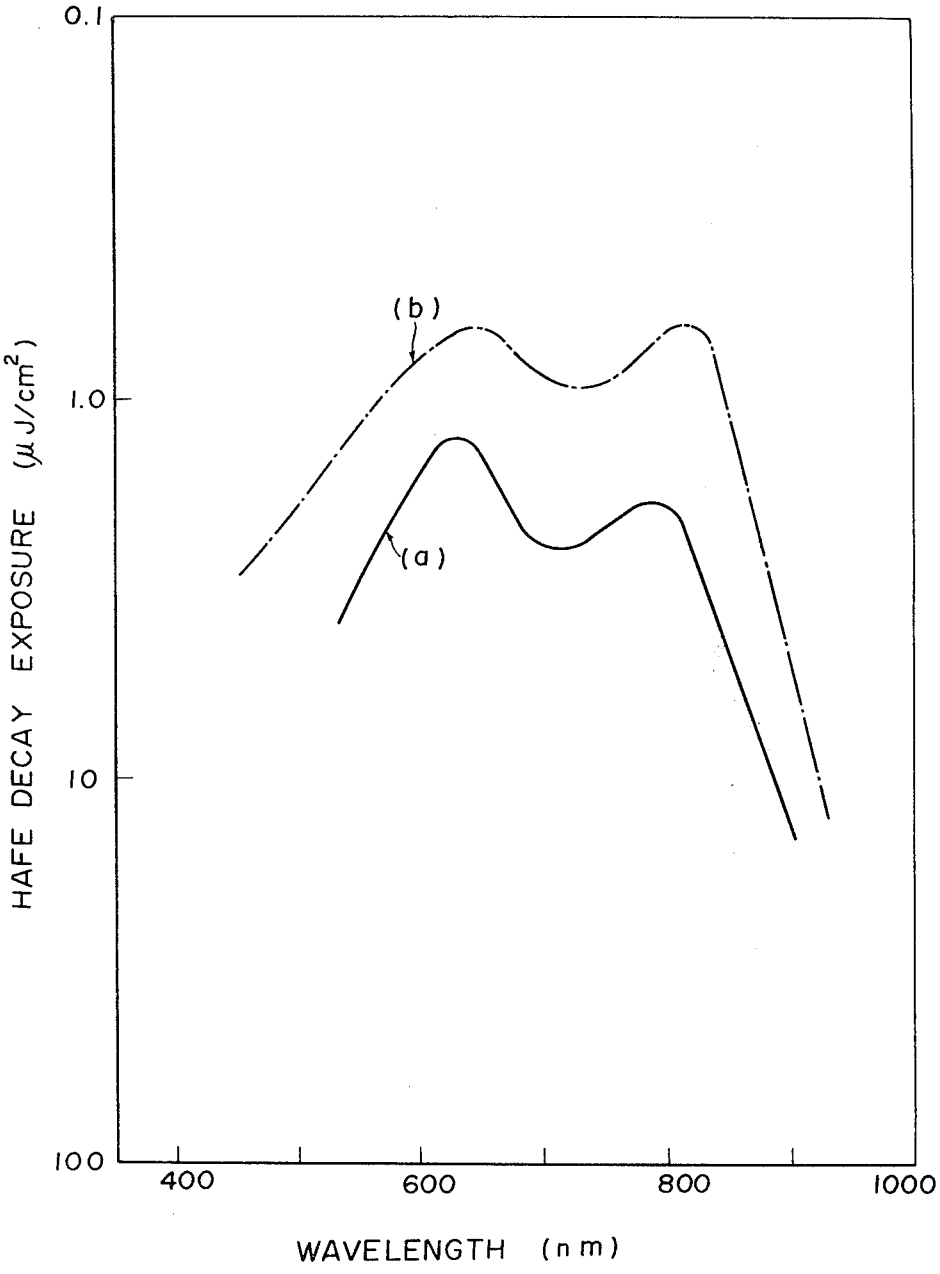

FIG. 3 shows a visible adsorption spectrum of chloroaluminium monochlorophthalocyanine film referred to A and chloroaluminium monochlorophthalocyanine film treated by an organic solvent referred to B herein film denotes evaporated film: and FIG. 4 shows spectral sensitivity of the photoreceptor which comprises chloroaluminium monochlorophthalocyanine film referred to A and chloroaluminium monochlorophthalocyanine film treated by an organic solvent referred to B.

An electrophotographic photoreceptor in the present invention comprising an electrically conductive substrate, a layer of charge generating material and a layer of charge transport material as double layer. Preferably, the suitable substrate is, for example, a plate of aluminium.

The substrate is flexible or rigid and have many different configuration such as a plate, a cylindrical drum, a scroll, an endless flexible belt and the like. The plate of aluminium is oxidized easily to form aluminium oxide layer in the air. As a result, a layer of aluminium oxide improves on the surface the potential voltage of the photoreceptor.

Figures 1A, 1B:
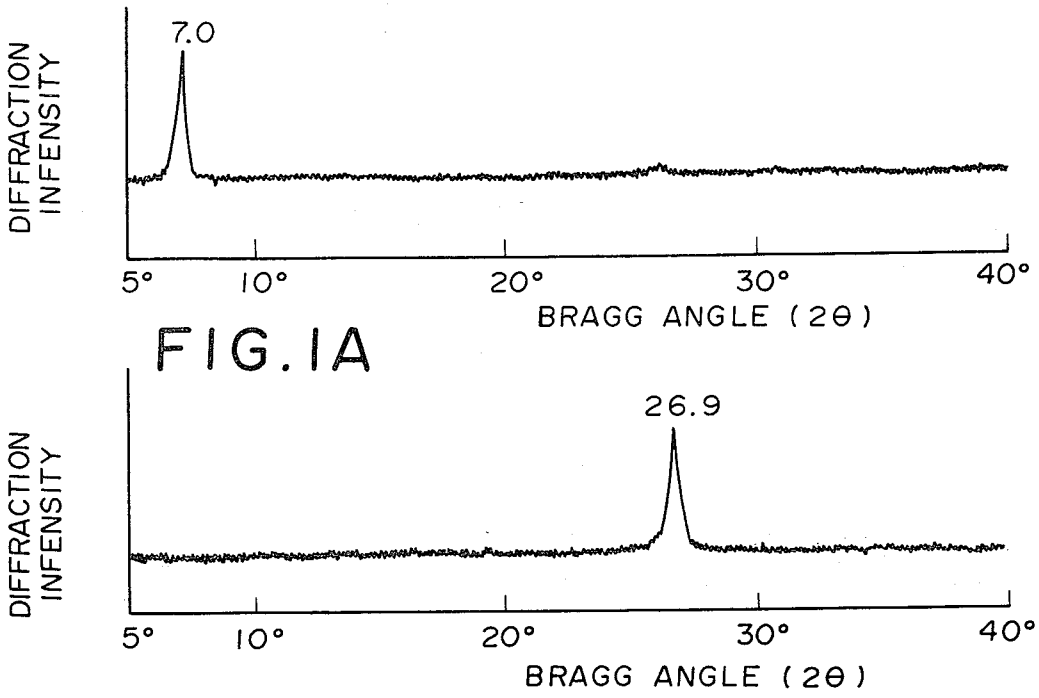
FIG. 1A is a graph showing X-ray diffraction spectrum of chloroaluminium monochlorophthalocyanine film.
FIG. 1B is a graph showing X-ray diffraction spectrum of chloroaluminium monochlorophthalocyanine film treated by an organic solvent.
Figure 2A:
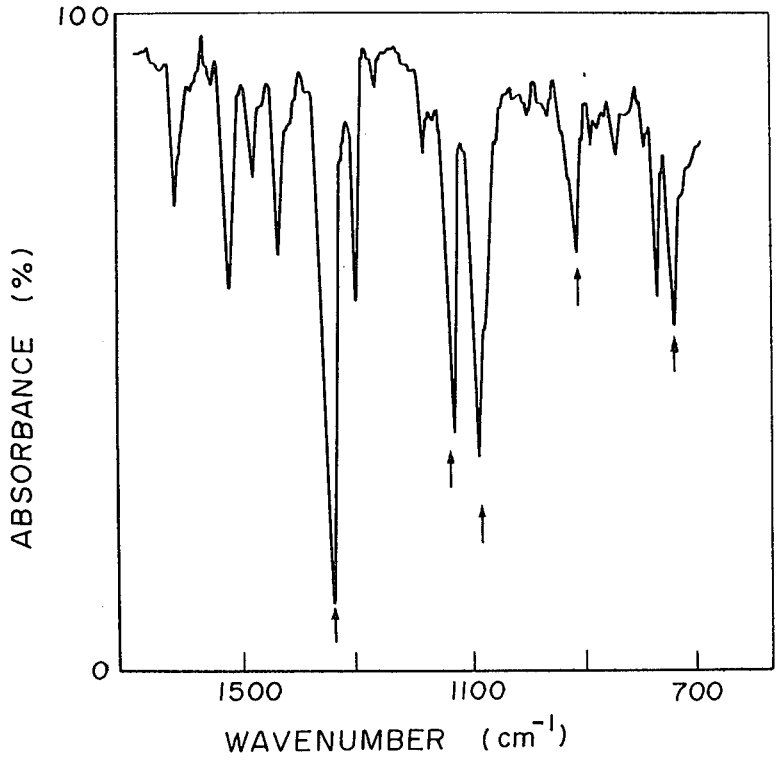
FIG. 2A shows an infrared adsorption spectrum of chloroaluminium monochlorophthalocyanine film.
Figure 2B:
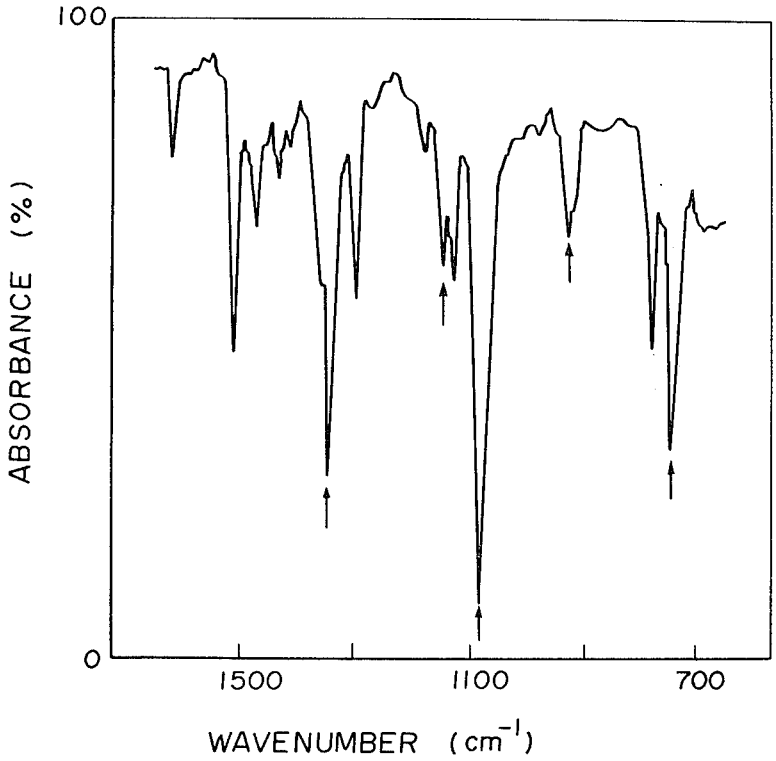
FIG. 2B shows an infrared adsorption spectrum of chloroaluminium monochlorophthalocyanine film treated by an organic solvent.

A charge generating material in the present invention is an evaporated film of metal phthalocyanine having absorption of light in the region of near infrared and a high coefficient of absorption. The metal phthalocyanines of the present invention are chloroaluminium phthalocyanine and chloroaluminium monochlorophthalocyanine. Chloroaluminium phthalocyanine and chloroaluminium monochlorophthalocyanine are evaporated over an aluminium substrate under conditions from about 10 to about $10^{-4}$ Pa in thickness of from 0.05 to 1 microns. This evaporated film of chloroaluminium phthalocyanine and chloroaluminium monochlorophthalocyanine is treated by an organic solvent. The organic solvents include tetrahydrofurane, methanol, acetone, methyl ethyl ketone, chloronaphthalene, and pyridine. Then the evaporated film of chloroaluminium phthalocyanine and chloroaluminium monochlorophthalocyanine treated by an organic solvent indicate a peak of absorption at 810 nM. The preparation of chloroaluminium phthalocyanine is the following method. Phthalonitrile 31 g is heated with trichloroaluminium 10 g in quinoline at a temperature of 240° C. for 120 min., subsequently cooling to room temperature. A resulting crude product is filtered and further is washed in Soxlet extractor with benzol. Chloroaluminium phthalocyanine yield about 20 g. A preparation of chloroaluminium monochlorophthalocyanine is carried out by the following method. Phthalonitril 20 g is heated to melt with trichloroaluminium 5 g at a temperature of 300° C., and the melted reaction product is heated further for 60 min. and subsequently is cooled to room temperature, thereafter the obtained crude product 20.3 g of chloroaluminium monochlorophthalocyanine is washed in Soxlet extraction with α-chrlonaphthalene. The purification of chloroaluminium monochlorophthalocyanine is sublimated in a vacuum at a temperature from 350° to 400° C. repeatedly several times. In order to observe the infrared spectrum and the visible spectrum of chloroaluminium monochlorophthalocyanine, chloroaluminium monochlorophthalocyanine is evaporated at $2\times10^{-4}$ Pa over a glass substrate or potassium bromide substrate in thickness of 0.08 microns. The evaporated film of chloroaluminium monochlorophthalocyanine refers to sample A. The evaporated film of chloroaluminium monochlorophthalocyanine is treated in contact with a saturated vapor of tetrahydrofuran in a closed glass vessel at 20° C. for two hours. The abovementioned solvent treated film of chloroaluminium monochlorophthalocyanine refers to sample B. FIG. 1A shows the X-ray diffraction with CuKα X-ray source of evaporated film of chloroaluminium monochlorophthalocyanine, FIG. 1B shows the X-ray diffraction of evaporated film of chloroaluminium monochlorophthalocyanine which is treated in contact with a saturated tetrahydrofuran vapor. The results of X-ray diffraction spectrum show a peak of 26.9° for sample A. For example the results of sample B show a shift: a peak of 7.0° from a peak of 26.9°. Also, FIG. 2A and FIG. 2B show the infrared adsorption of chloroaluminium monochloroaluminium phthalocyanine evaporated film. FIG. 2B is a spectrum showing infrared absorption of chloroaluminium monochlorophthalocyanine evaporated film which is treated by the saturated tetrahydrofuran vapor. In comparison with infrared spectrum of sample A and sample B, it is found clearly that the change of absorption spectrum is observed especially in 1450–1300 $cm^{-1}$, 1150–1050 $cm^{-1}$ and 800–700 $cm^{-1}$ respectively. In FIG. 2B, sharp absorption peaks present at 1332 $cm^{-1}$, 1066 $cm^{-1}$, 765 $cm^{-1}$, 728 $cm^{-1}$ respectively and weak absorption peaks present at 1133 $cm^{-1}$, 1118 $cm^{-1}$, 917 $cm^{-1}$ respectively. The results of X-ray diffraction spectrum and infrared adsorption spectrum indicate that a change of crystal form of chloroaluminium monochlorophthalocyanine evaporated film is caused by the treatment by tetrahydrofuran vapor. This change of the crystal form does not obtain with the heat treatment of phthalocyanine compounds. Also the evaporated film of chloroaluminium phthalocyanine indicates a similar result to that of evaporated film of chloroaluminium monochlorophthalocyanine treated by organic solvent in X-ray diffraction spectrum and infrared adsorption spectrum.

The solvent treatment of the evaporated film of chloroaluminium monochlorophthalocyanine in the present invention is carried out by a method of contact with saturated vapor of an organic solvent during a time ranging from several minutes to several hours and by a method of dipping in an organic solvent during from one to three seconds. The organic solvent is a good solvent to metal phthalocyanines and metal-free phthalocyanine, such as, for example, tetrahydrofuran, methanol, acetone, methyl ethyl ketone, α-chloronaphthalene and pyridine. If tetrahydrofuran is used as the solvent of the treatment, the evaporated film of chloroaluminium monochlorophthalocyanine is contacted with the saturated vapor of tetrahydrofuran at a temperature of 10° C. for three hours, or at a temperature of 40° C. for 30 min. in a closed vessel. Also similarly, if acetone is used as the solvent of the treatment the evaporated film of chloroaluminium monochlorophthalocyanine provide for contact with the saturated vapour of acetone in closed vessel at a temperature of 20° C. for three hours, or at a temperature of 40° C. for one hour. In the case of solvent treatment by dipping, the evaporated film of chloroaluminium monochlorophthalocyanine is dipped in tetrahydrofuran solution at room temperature for one second and thereafter the treated film is dried in a vacuum oven at room temperature. If methanol is used as the solvent in dipping treatment the evaporated film of chloroaluminium monochlorophthalocyanine is dipped in methanol solution at room temperature for two seconds and thereafter treated film is dried in a vacuum oven at room temperature. FIG. 3 shows visible absorption of chloroaluminium monochlorophthalocyanine evaporated film.

In this case sample A refers to evaporated film of chloroaluminium monochlorophthalocyanine, on other hand sample B refers to a film of chloroaluminium monochlorophthalocyanine treated by an organic solvent. In FIG. 3 the ordinate corresponds to coefficient of absorption and the abscissa corresponds to wavelength. The wavelength corresponding to maximum coefficient of absorption in sample A is 740 nM in sample B it is 810 nM. The visible absorption shows similar results to that described in observation of X-ray diffraction and shows infrared adsorption and a shift to cover 800 nM.

The layer of charge transport material comprises the charge transport material and its binder. The charge transport material can be solved or dispersed in binder generally. The charge transport compound is an electrically active molecule which is dispersed in the electrically inactive synthetic resin. The binder is an electrically inactive synthetic resin herein. The charge transport material of the present invention include N-vinyl carbazol, 2.5-bis(4-diethyl amino phenyl)-13.5-oxadiazole, 1-phenyl-3-(p-diethyl amino styryl)-5-(p-diethyl amino phenyl)-pyrazoline, 1-phenyl-3-methyl-5-pipazoline, p-diethyl amino oxobenzene, acetbenzothiazyl-2-hydrazone p-diethyl amino benzilidene hydrazone. The binder of the present invention includes polyvinylchloride, vinyl chloride-vinyl acetate copolymer, polycarbonate, polystyrene, styrenebutadiene copolymer, polyurethane, epoxy resin, phenoxy resin, polyamide, acrylic resin, silicon resin, poly methyl methacrylate. The ratio of the charge transport material to the binder ranges from 0.1 to 0.8, preferably, from 0.3 to 0.6. When this ratio becomes smaller than 0.1, the sensitivity of the photoreceptor shows a small value, therefore, the residual potential of the photoreceptor shows a large value. When this ratio of the charge transport material to the binder became larger than 0.8, the surface voltage of the photoreceptor shows a small value, therefore, the dark decay of the photoreceptor shows a large value. The layer of charge transport material of the present invention varies from 10 to 20 microns in thickness by reason of the sufficient surface voltage of the photoreceptor. In a preferred embodiment of the electrophotographic photoreceptor in the present invention, the electrically conductive substrate is a plate of aluminium, the layer of charge generating material is an evaporated film of chloroaluminium phthalocyanine and chloroaluminium monochlorophthalocyanine treated by an organic solvent, the layer of charge transport material is p-diethyl amino benzilidene hydrazone dispersed in polymethyl methacrylate and chloroform. The evaporated film of chloroaluminium phthalocyanine and chloroaluminium monochlorophthalocyanine that is treated by an organic solvent used in the photoreceptor according to the present invention shows high sensitivity in region near infrared especially over 750 nM, therefore, the electrophotographic photoreceptor can be applied to a laser printing machine making, used in laser diodes or as a light source. The following examples are included for a further understanding of the invention of the present application.

EXAMPLE 1

Chloroaluminium monochlorophthalocyanine was evaporated over a plate of aluminium in a standard bell jar type of apparatus in vacuum from 10 to $10^{-4}$ Pa to 900 angstroms in thickness. This evaporated film was treated in contact with a saturated vapor of tetrahydrofuran in closed vessel at a temperature 10° C. for six hours. This treated film which functions as a layer of charge generating material in the present invention was overcoated by the spin coating with mixture of 10 weight parts p-diethyl amino benzilidene diphenyl hydrazone, 10 weight parts poly methyl methacrylate and 80 weight parts chloroform having a thickness of approximately 20 microns. The uniformly coated film was dried in a vacuum oven at a temperature 50° C. for one hour. Herein p-diethyl amino benzylidene diphenyl hydrazone functions as charge transport material. The electrophotographic photoreceptor comprises aluminium substrate, chloroaluminium monochlorophthalocyanine film and p-diethyl amino bezilidene diphenyl hydrazon dispersed in polymethyl methacrylate and chloroform solution.

The above-mentioned photoreceptor was examined to measure the photosensitivity of photoreceptor by using an electrostatic characteristic analyser manufactured by Kawaguchi Denki K.K. The sensitivity of photoreceptor was evaluated by the quantity of light required for half decay of the initial surface potential, when illuminated by monochromatic light passing through monochlometer from a 500 W xenon lamp used as light source. The surface of the photoreceptor was charged with negative polarity by discharge of 6 kV. The result was 0.5 $\mu J/cm^2$ of half decay exposure at 830 nM of wavelength and 700 V of acceptance voltage. FIG. 4 is graph showing half decay exposure of the photoreceptor compared with chloroaluminium monochlorophthalocyanine film referred to as A and chloroaluminium monochlorophthalocyanine treated by tetrahydrofurane vapour referred to as B. In FIG. 4, the ordinate shows half decay exposure ($\mu J/cm^2$) and the abscissa shows wavelength (nM). It is clearly found in FIG. 4 that the photoreceptor making use of sample B according to the present invention showed a peak of sensitivity over 800 nM and improved photosensitivity in all wavelengths.

EXAMPLE 2

Chloroaluminium phthalocyanine was evaporated over a plate of aluminium in a standard ball jar type of apparatus under from $10^{-3}$ to $10^{-4}$ Pa about 1000 angstroms in thickness. This evaporated film was treated to dip in acetone for three seconds, thereafter selenium was evaporated over the treated film of chloroaluminium phthalocyanine to 10 microns in thickness whereby selenium functions as a charge transport material having sensitivity in the visible region.

This photoreceptor shows similar photosensitivity that described in Example 1. The electrophotographic photoreceptor which used chloroaluminium phthalocyanine film that was treated by dipping in acetone according to the present invention showed 0.6 $\mu J/cm^2$ of half decay exposure at 830 nM.

What is claimed is:

1. A method of preparation of an electrophotographic photoreceptor for use in laser printing machines comprising:
   - evaporating over an electrically conductive substrate under vacuum from about 10 to about $10^{-4}$ Pa on a film selected from the group consisting of chloroaluminium phthalocyanine, and chloroaluminium monochlorophthalocyanine:
   - treating said film with an organic solvent constituting a good solvent for said film; and
   - overcoating said treated film with a layer of charge transport material.

2. A method of preparation of a photoreceptor in accordance with claim 1 wherein the electrically conductive substrate is aluminum.

3. A method of preparation of photoreceptor in accordance with claim 1 wherein the organic solvent is selected from the group consisting of tetrahydrofuran, methanol, acetone, methyl ethyl ketone, α-chloronaphthalene and, pyridine.

4. A method of preparation of a photoreceptor in accordance with claim 1 wherein the treatment with said organic solvent takes place by contacting said film with tetrahydrofuran vapor at a temperature ranging from 10° C. to 40° C. during a period of time ranging from 30 minutes to three hours.

5. A method of preparation of a photoreceptor in accordance with claim 1 wherein the treatment of a organic solvent takes place by dipping said film in tetrahydrofuran at room temperature for one second.

6. A method of a preparation of photoreceptor in accordance with claim 1 wherein the layer of charge transport material comprises an insulating organic synthetic resin and a charge transport material.

7. A method of preparation of a photoreceptor in accordance with claim 1 wherein the layer of charge transport material comprises p-diethy amino benzilidend hydrazone of 10 parts by weight, poly methyl methacrylate of 10 parts by weight and chloroform of 80 parts by weight.

* * * * *